US006412974B1

(12) United States Patent
Scholl et al.

(10) Patent No.: US 6,412,974 B1
(45) Date of Patent: Jul. 2, 2002

(54) LIME SLURRY MIXING APPARATUS AND METHOD OF USE

(75) Inventors: Kim Wiley Scholl, Fort Worth, TX (US); Jeffrey DiGuillo, Henderson, NV (US)

(73) Assignee: Chemical Lime Company, Ft. Worth, TX (US)

( * ) Notice: Subject to any disclaimer, the term of this patent is extended or adjusted under 35 U.S.C. 154(b) by 0 days.

(21) Appl. No.: 09/345,177

(22) Filed: Jun. 30, 1999

(51) Int. Cl.[7] ..... B01F 15/02
(52) U.S. Cl. ..... 366/191; 366/51; 366/64
(58) Field of Search ..... 366/26, 51, 62, 366/63, 64, 182.2, 190, 282, 305, 606, 61, 191

(56) References Cited

U.S. PATENT DOCUMENTS 3,773,303 A * 11/1973 Griffith ..... 366/4
3,792,838 A * 2/1974 Jacopini et al. ..... 366/45
4,075,711 A * 2/1978 Hall
4,117,547 A * 9/1978 Mathis et al. ..... 366/17
4,329,090 A * 5/1982 Teague et al. ..... 405/263
4,441,820 A * 4/1984 Maxon, III
4,487,507 A * 12/1984 Van Wyngaarden
4,955,723 A 9/1990 Schneider
5,005,980 A * 4/1991 Zimmerman ..... 366/153.3
5,261,739 A * 11/1993 Da Costa Goncalves et al.
5,275,487 A 1/1994 Rumph
5,277,491 A 1/1994 Burnett et al.
5,507,572 A 4/1996 Shields et al.
6,093,247 A * 7/2000 Sipos et al. ..... 118/302

* cited by examiner

*Primary Examiner*—Charles E. Cooley
(74) *Attorney, Agent, or Firm*—Bracewell & Patterson, LLP

(57) ABSTRACT

The present invention is a single-entity lime slurry reactor for production and delivery of lime slurry to remote jobsites. The reactor includes a tank body with an interior surface which forms a mixing chamber. The tank is coupled to a unitary frame and rests substantially parallel to the ground. A pair of spaced apart inlets located on the tank allow the delivery of solid lime to the tank from a carrier parked next to the apparatus. Power units are attached to the device in order to make it self-contained. A rotatable outlet allows slurry to be discharged to a tanker truck or other carrier. A vertical placement device is used for placing the frame, tank body, and power unit in a working position once at a jobsite and a raised position when pulling the apparatus on a highway.

14 Claims, 2 Drawing Sheets

LIME SLURRY MIXING APPARATUS AND METHOD OF USE

BACKGROUND OF THE INVENTION

1. Field of the Invention

The present invention relates in general to the production of lime slurry and the transportable reaction/mixing apparatus used to manufacture the slurry. Specifically, the present invention relates to a single-entity apparatus for mixing solid lime and water to form a lime slurry that can be operated and transported by one person to a remote jobsite.

2. Description of the Prior Art

Calcium based compounds such as CaO and $Ca(OH)_2$ have many practical uses. For instance, these substances are used in treating waste water and sewage, soil neutralizing agents and nutrients, ground stabilization for construction, and components for building materials.

Calcium oxide (CaO) is often referred to as quicklime, while $Ca(OH)_2$ is referred to as hydrated lime-both being referred to as "lime". Quicklime is usually in the form of lumps or pebbles. Dry hydrated lime is usually a powder. In order to further process these compounds and improve the ease with which they are handled, dry CaO or $Ca(OH)_2$ is usually mixed with water to form a slurry. In the case of quicklime, the water reacts with the quicklime in an exothermic reaction to form hydrated lime. This is often referred to as slaking. During the slaking of quicklime, large amounts of heat are generated which can significantly raise the temperature of the slurry.

Lime slurries can be made in batches or in a continuous process. If a particular user requires a large amount of lime slurry at a particular site, large capacity slaking and storage tanks can be permanently located on the site. These tanks can usually provide a sufficient supply of lime and lime slurry for most operations. Often, however, it is not practical to provide permanent slaking or storage tanks for forming lime slurries. In the agricultural industry and in some construction industries, lime may be required only periodically or during certain seasons. Here, the limited use of lime may not justify the investment required for construction and maintaining large capacity processing tanks and equipment. In other industries the location of the jobsites may change from day to day, such as in road construction, so that permanently located processing and storage tanks would be impractical. Here, lime slurries would have to be made at permanent lime processing facilities and then pumped into tanks to be hauled to the specific job locations.

Portable equipment for forming lime slurries which can be moved from site to site, are described by Teague et al. (U.S. Pat. No. 4,329,090) and Shields et al. (U.S. Pat. No. 5,507,572). These devices have several drawbacks, however. The major drawback to these devices is that they are large and cumbersome, requiring several pieces of equipment that need to be hauled separately, thus requiring more manpower and expense to operate. In the Shields et al. device, there is no capacity of delivering the slurry made in the tank to tank trucks for spreading the hot lime slurry to a road surface. To achieve that function, it was necessary to have an additional piece of equipment that could take the hot lime slurry from the device and pump it to the delivery truck using a separate, additional piece of equipment. This equipment had to be brought to the remote jobsite by a separate truck and thus required additional expense, power source, and manpower. This limits the commercial applicability of the devices to larger sites and larger projects. Small projects and sites where space is limited, which are often the case, are thus impractical for use for the transportable lime slurry devices to date.

Some lime consumers do not purchase quicklime and slake it for their own consumption. Indeed, most cannot justify the cost of capital slaking equipment and the problems attendant to another processing step that slaking entails. Their lime requirements are simply too small. Consequently in order to make slaked lime more economical, an improved method of slaking and the apparatus used for slaking is highly desirable.

What is needed is an easily transportable device that can expand the practical commercial use of lime slurries at remote sites. This would require an apparatus that can be operated by one man and being self-contained such that all the power sources and equipment necessary for the slurry operation are on one unit. This invention is directed towards such an apparatus and method of producing lime slurries.

SUMMARY OF THE INVENTION

The present invention is a single-entity lime slurry reactor for production and delivery of lime slurry to remote jobsites. The reactor is an apparatus comprising a unitary frame substantially parallel to the ground and having a horizontal axis. A tank body is attached to the frame, the tank body having a horizontal axis parallel to the horizontal axis of the frame, a generally cylindrical exterior, and an interior surface, the interior surface forming a mixing chamber. Power units are attached to the device in order to make it self-contained. A power unit, typically a diesel powered engine, is coupled to the frame for powering hydraulic units such as a mixer, suction pump, and delivery pump. A transport means is used to transport the apparatus to a jobsite such as a tractor, the apparatus being pulled from a forward platform and trailer hitch arrangement, or other means. In order to make the apparatus both appropriate for the highway and a mixing apparatus at a jobsite, a vertical placement means is provided. The vertical placement means is used for placing the frame, tank body, and power unit in a working position once at a jobsite and a raised position when pulling the apparatus on a highway, the working position being such that the frame is against the ground and supporting the tank body and the raised position being such that the frame and tank body clear the ground surface sufficiently to travel on a highway.

At least two inlets attached to both sides of the tank body are provided. The inlets are arranged such that solid lime can be introduced below the surface of a slurry formed within the mixing chamber. There is also a rotatable and retractable delivery outlet which is rotatable to one side of the apparatus for slurry delivery, and can extend above a truck or other carrier located alongside the apparatus.

The tank body forms a mixing chamber therein, where a mixing device such as an auger is located. The auger is powered by a hydraulic unit located on either the forward platform, or a rear platform. Other power units are also located on the rear platform. Also, wheels may be located on the rear platform for facilitating the towing of the apparatus behind a vehicle.

Additional objects, features and advantages will be apparent in the written description which follows.

DETAILED DESCRIPTION OF THE INVENTION

To make the use of lime slurries economically and physically practical at small construction and roadwork jobsites, a single-entity lime slurry apparatus is described that can be operated by one person. The design of the present invention starts with the basic concepts disclosed by Shields et al. (Pat. No. 5,507,572), but with several distinctions. The design differences and advantages to the present invention are described more fully below.

A slaking or lime hydrating apparatus is the keystone of a hydration process for liming compounds. Slaking is complex due to the highly exothermic nature of the CaO hydration reaction, and the multitude of variables that can effect the final properties of the slaked lime. This is why an improved portable means of slaking lime is needed. Controlling variables such as temperature is important. Temperature-control equipment and a means for venting off some of the heat of hydration is essential, as well as control of lime dust. Generally, it is desirable to control the temperature below boiling and above 180° F. or 82° C. Although this has been achieved in stationary plants, it is advantageous to have a portable means of slaking for small jobsites.

As discussed previously, the lime used in this invention may be quicklime, hydrated lime or other raw material sources such as lime kiln dust. In many cases, the use of quicklime may be preferable because of the heat generated during slaking and the ease with which the lumps or pellets of quicklime can be unloaded and delivered to the tank of the invention.

In forming lime slurries, the water used may vary in quality. Conventional water sources include city water mains, wells, railroad storage facilities, highway department storage facilities, lakes, streams, and other similar sources.

Figure 1:
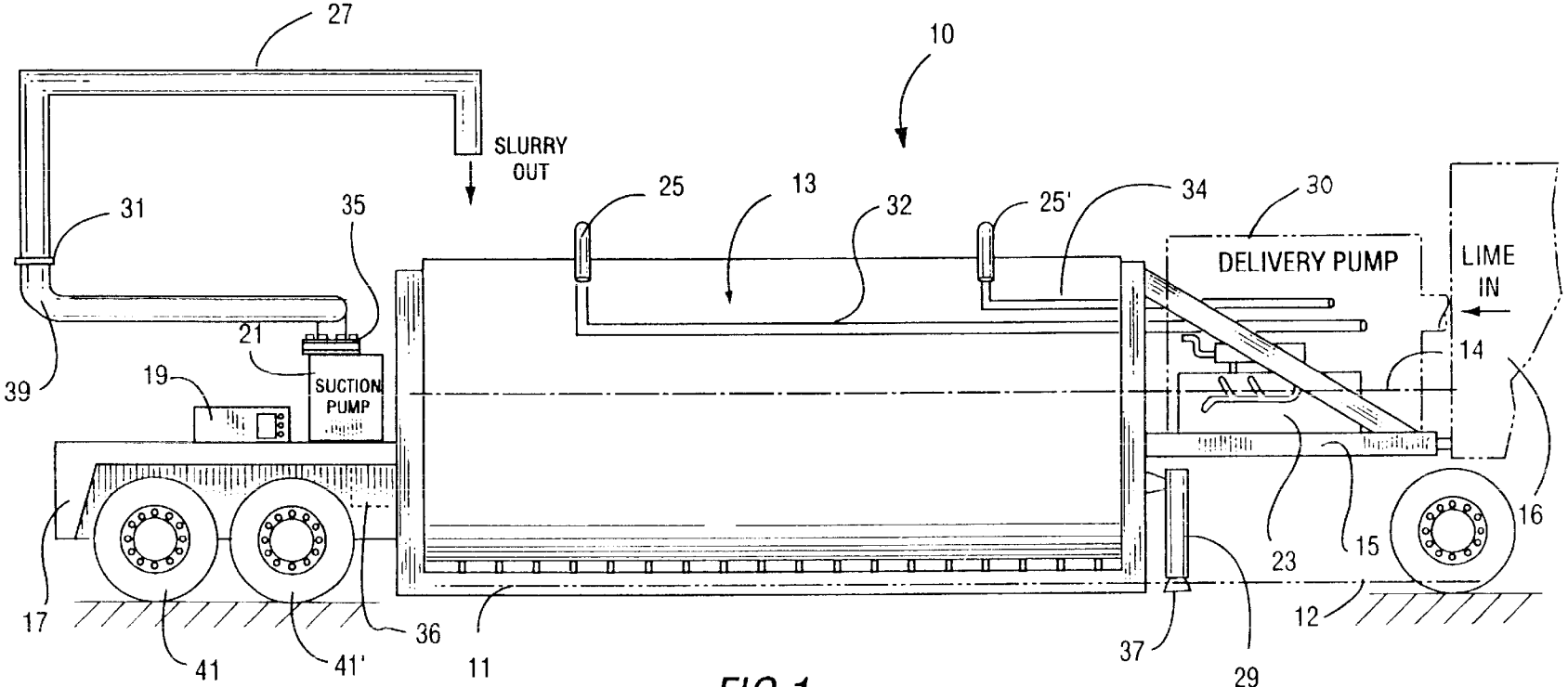
FIG. 1 is a partially schematic side view of the apparatus in its working position.
Figure 2:
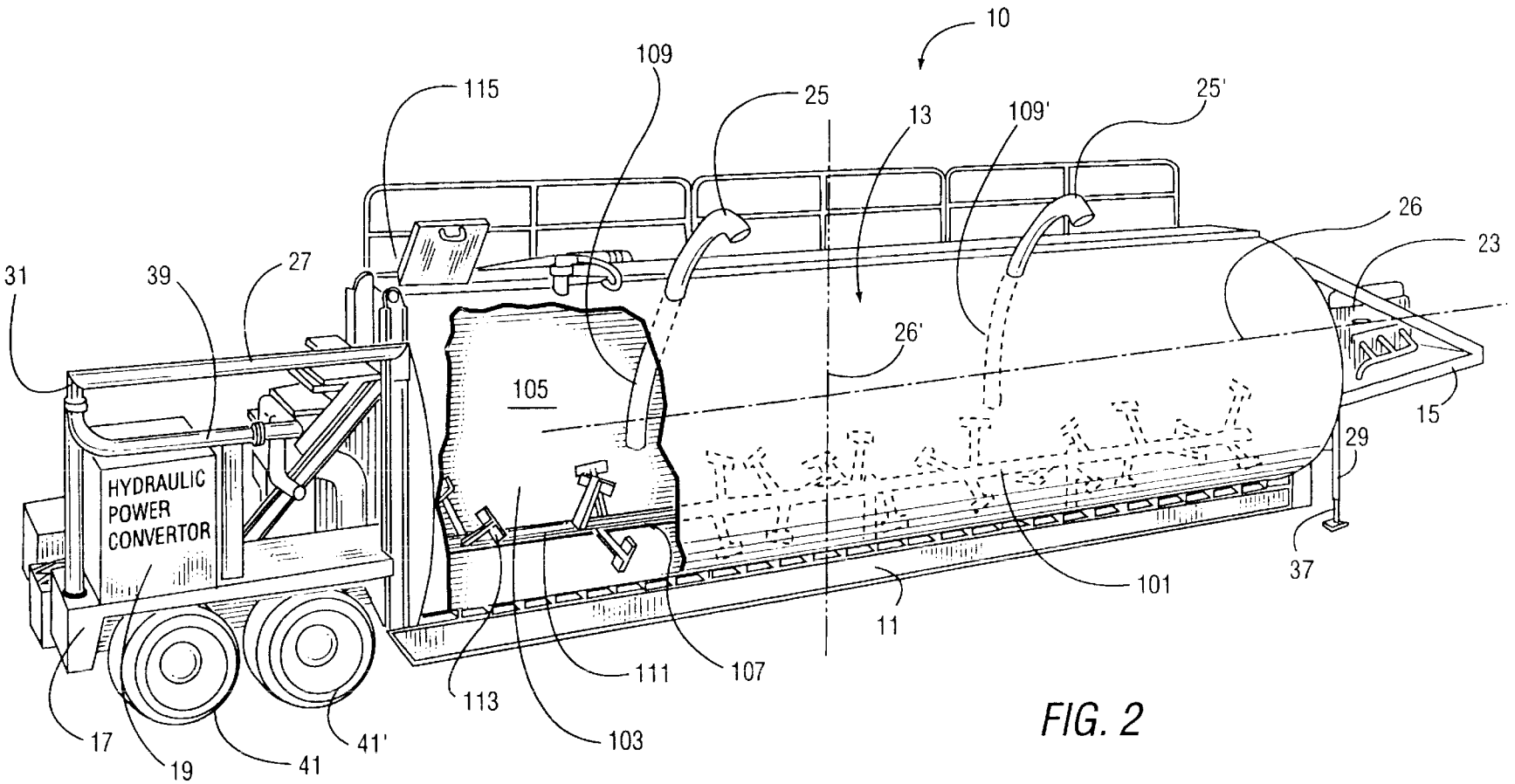
FIG. 2 is a side perspective view of the apparatus in its raised position, a portion of the tank sidewall being broken away for ease of illustration.

Referring to FIG. 1 and FIG. 2, the apparatus 10 used in performing the method of the invention is shown. The apparatus has a unitary frame 11 (FIG. 1) that is substantially parallel to the ground, road, or highway when in use. The frame has a horizontal axis 12. Tank body 13 is attached to the frame 11, being held in place by various fastening means such as bolts, welding, and the like. The tank body has a horizontal axis 14 parallel to the horizontal axis 12 of the frame. The tank body has an exterior surface 101 and an interior surface 103 (FIG. 2), the tank body forming at least one mixing chamber 105 (FIG. 2). The tank body is formed such that the temperature of the hydration reaction within can be controlled. The tank radiates heat generated by the reaction, and the rate of addition of the solid lime can further control the temperature. Thus, the walls of the tank body serve as one means of controlling the reaction temperature, the walls easily radiating the heat generated within the mixing chamber 105 to the external surroundings. In conjunction with the walls, the rate of addition of lime to the water within the mixing chamber 105 also serves as a temperature control means.

Within the mixing chamber 105 is the mixer 107 (FIG. 2), the mixer in the present embodiment being an auger with a plurality of paddles 113 extending perpendicularly along the shaft 111. The mixer is driven by a hydraulic power unit (19 in FIG. 2 ) which can be located on either the forward or rear platforms, the shaft 111 being driven to turn the paddles. The liquid and solid additives will fill the mixing chamber 105 to substantially cover the mixer. Once the mixing auger is activated it will sufficiently agitate the slurry, thus facilitating the hydration reaction and creating a more consistent mix of material.

Referring back to FIG. 1, the single-entity reactor has a complete power unit assembly built into the apparatus, the assembly comprising a combustion power unit and other hydraulic power units that are driven by the combustion power unit. The single or multiple power units are attached to platforms. Forward platform 15 is used to contain at least power unit 23. Power unit 23 is a combustion engine, typically being a diesel engine. The combustion engine 23 serves to power all other devices on the apparatus indirectly; the combustion engine is coupled to the hydraulic power converter 19 that converts the torque of the combustion engine drive shaft into hydraulic power. This hydraulic power is then communicated through hydraulic lines to other hydraulic power units on the apparatus, such as, for example, hydraulic landing cylinder 29, suction pump 21, and a delivery pump (shown in phantom lines as 30 in FIG. 1). The suction pump 21 is used to draw slurry from the tank 13 to primary tube 39 and delivery outlet 27, while the delivery pump is used to draw solid lime from an external source into the tank 13 through inlets 25 and/or 25'.

The forward platform 15 may also serve as a trailer hitch to be reversibly attached to a tractor or other transport means such as vehicle 16 in FIG. 1 capable of pulling the apparatus 10. The rear platform 17 is used to contain at least the hydraulic converter 19 and the suction pump 21.

The tank body 13 can be one single compartment or can be divided into separate compartments. Generally, the tank body is one compartment. In a multi-compartment embodiment, one compartment can be for the initial reaction and mixing of the lime and water, and another compartment can be used to hold the reacted and ready to use slurry so that a continuous feed of slurry can be provided. The pump 21 in that case would pump slurry from the compartment holding slaked lime to the delivery outlet 27. Another pump would be provided to pump the slaked lime from the reaction compartment to the holding compartment.

In order to expedite the delivery of the quicklime solid to the apparatus at a small jobsite, at least two inlets 25 and 25' are provided for each side of the apparatus 10. The inlets penetrate the tank body 13 at spaced apart vertical locations on the external cylindrical sidewall thereof. The spaced locations are above an imaginary midline (26 in FIG. 2) drawn to intersect the cylindrical sidewall and further with respect to imaginary vertical axis 26' and divide the sidewall into quadrants. The horizontal spacing of the inlets is determined by the nature of the delivery means, i.e., the size of the delivery truck utilized, etc. Thus, a truck can pull alongside either side of the apparatus 10, and hoses can be attached to the inlets 25 and 25'. The inlets are arranged such that the quicklime is pumped below the surface of the water level inside the tank body 13. This is accomplished by providing tank inlet extensions 109 and 109' (FIG. 2), the extensions protruding from the inlets 25 and 25' down into the water within the tank. This improves the mixing of the solid and the water in the tank and prevents the lime dust from becoming airborne. Once the quicklime is added to water inside the tank, the mixture is agitated using a mixing device such as auger 107. The augers are driven by a hydraulic motor attached to the platform 15 or 17.

The reacted, hot slurry is then pumped by suction pump 21 from the tank body 13 to delivery outlet 27. The delivery outlet is shown in its assembled delivery position in FIG. 1, and in a disassembled, traveling position in FIG. 2. The delivery outlet is a rigid tube that is coupled to primary tube 39 through joint 31. Primary tube 39 is coupled to the pump 21 though joint 35. Joint 35 is designed to support the weight of the delivery outlet 27, primary tube 39, and the contents thereof as slaked lime is pumped from the tank 13 to a holding truck or tank exterior to the apparatus. Outlet 27 is stored away on the rear platform when disassembled, outlet 27 being lifted and joined at joint 31 when in the working position as in FIG. 1. Any suitable seal means, such as an O-ring seal in a mating groove can be used to provide a fluid seal at joint 31. In the assembled delivery position, the outlet is rotatable about the pivot point formed by joint 31. The delivery outlet is rotatable about one side of the apparatus, and extends above a truck or other storage/transport device located alongside the apparatus to be loaded with the lime slurry. Both the external solid lime lines leading to inlets 25 and 25' (shown schematically as 32 and 34 in FIG. 1) and the outlet 27 can be attached and assembled by one person.

The apparatus 10 also has a vertical placement means for lowering the unitary frame 11 and tank 13 to the ground when at a jobsite, and lifting it from the ground while traveling on a highway. The vertical placement means in the present embodiment is a hydraulically powered set of retractable wheels, a hydraulic wheel assembly (36 in FIG. 1) being located behind the wheels 41 and 41' (and opposing wheels not shown) and beneath platform 17 as shown in the embodiment of FIGS. 1 and 2. Hydraulic landing cylinder 29, one located on either side of the tank, is used to support the apparatus along with wheels 41 and 41' when a tractor that is pulling the apparatus is being removed from the hitch 15. Support post 37 extends from the hydraulic landing cylinder 29 when in the supporting position, the hydraulic landing cylinder and post able to support the weight of the apparatus and contents therein. The apparatus 10 is in a working position as shown in FIG. 1 when at a jobsite, the unitary frame making contact with the ground or other solid surface in order to support the apparatus. The apparatus is in a raised position when traveling on a road or highway, the frame 13 being raised enough to allow proper clearance to drive on a road or highway. FIG. 2 shows the apparatus in a raised position as it would be just before or after being towed to or from a jobsite, the wheels lifting the apparatus from the ground, while the support posts 37 are extended to support the opposite end of the apparatus. When traveling on a road or highway, the support posts 37 are raised as in FIG. 1 while a tow vehicle (16 in FIG. 1) supports the end of the apparatus 10 opposite the wheels.

In order to provide the lime slurry, the apparatus 10 is transported by means of truck or tow vehicle 16 to a desired location which is remote from a lime processing plant. The platform 15 can serve as a trailer hitch or "5th wheel" to attach the apparatus to a towing vehicle. Once attached, support posts 37 are retracted to allow towing. Separate trucks or tanks are used to carry a supply of dry quicklime or hydrated lime to be used in forming the lime slurry. Once the apparatus is located at the remote jobsite, the apparatus is lowered into its working position using the hydraulic powered retractable wheels. Next, the tank 13 is filled with water from a suitable water source. When the tank body 13 is filled with water, the quicklime or hydrated lime is then blown or otherwise introduced into the tank through inlet(s) 25 and/or 25' below the water level inside the tank through 109 and 109'. Simultaneous to this, the mixture is stirred by activation of the mixing device, or augers 107.

The amount of lime solids added to the tank 13 may range between 20–45% by weight to that of the total lime slurry. For example, 158,000 lbs. of water may be used to fill the tank to a preselected level. To this may be added 50,000 lbs. of lime. The lime used may be either quicklime or hydrated lime. High calcium lime is usually preferable for most applications, although dolomitic lime can be used. The lime may have impurities but will ordinarily be better than 90% CaO or $Ca(OH)_2$, depending on the type of lime used.

The delivery outlet 27 can be used in two ways. First, it can be used to deliver the lime slurry to a loading truck or other carrier located alongside the apparatus. In one embodiment of the invention, the suction pump 21 and primary tube 39 are arranged such that it is more convenient to have the loading truck or carrier pull along only one side of the apparatus 10. Thus, the carrier or loading truck may be located along one side of the apparatus 10 closest to the suction pump 21 and primary tube 39. In another embodiment of the invention, the primary tube 39 and delivery outlet 27 may be adapted such that a load truck may pull along either side of the apparatus 10. This would be accomplished by extending the length of primary tube 39 to reach across the apparatus 10 so that it can sufficiently reach either side of the apparatus 10.

The second use for the delivery outlet 27 is as a recirculator. The outlet can be used to recirculate the lime slurry from the bottom of the tank body to the surface of the material in the tank body. This is accomplished by placing the outlet at a recirculator inlet 115 located near the top of the tank at an opening to allow lime slurry to pass back into the tank to be further mixed. This improves the consistency of the lime slurry by increasing the mixing. Also, a screen can be placed within the delivery outlet to filter out any larger, unmixed chunks of material. In either case, suction pump 21 is used to pump the lime slurry from the tank to the outlet.

The novel design of the present invention incorporates all necessary pumps and distribution lines into one apparatus so that the apparatus of the invention is self-contained in one entity and does not require additional power sources, transportation and manpower expense. The delivery outlet is retractable, thus maintaining the size and weight limitations for easy highway transportation without additional permits.

The present invention is thus an improvement over the prior art in that it allows a wider range of application at smaller (physically and economically) jobsites. The vertical placement means coupled with the unique delivery outlet allows the device to be taken from one site to another with only one person. The apparatus can be set up and in operation in as little as one hour.

Another advantage to the present invention is that the slurry pump can be used to recirculate the slurry as it is formed to provide improved consistency and an inline screen can be provided to filter any large chunks of undissolved lime.

Also, the inlets of the invention allow for ease of use, allowing a truck or other carrier to pull alongside the apparatus and thus load quicklime directly to the tank by making a simple connection from the truck or carrier to the tank body.

While the invention has been shown in only one of its forms, it is not thus limited but is susceptible to various changes and modifications without departing from the spirit thereof.

What is claimed is:

1. A single-entity reactor apparatus for lime slurry production and delivery to remote jobsites comprising:

a unitary frame substantially parallel to the ground and having a horizontal axis;

a tank body attached to the frame, the tank body having a horizontal axis parallel to the horizontal axis of the frame, a generally cylindrical exterior, and an interior surface, the interior surface forming a mixing chamber;

a power unit coupled to the frame and connected to a mixer located within the mixing chamber, the power unit also being connected to a suction pump and to a delivery pump, both of which are located externally of the tank body, for powering the mixer, suction pump, and delivery pump;

a transport means for transporting the apparatus to a jobsite;

a vertical placement means for placing the frame, tank body, and power unit in a working position once at a jobsite and a raised position when pulling the apparatus on a highway, the working position being such that the frame is against the ground and supporting the tank body and the raised position being such that the frame and tank body clear the ground surface sufficiently to travel on a highway; and at least two inlets located on the cylindrical exterior of the tank body such that solid lime can be introduced below the surface of water or slurry within the mixing chamber;

wherein a delivery outlet is provided, connected with and in communication with the suction pump, the delivery outlet being rotatable about a vertical axis which is generally perpendicular to the horizontal axis of the frame, and can extend above a truck located along side the apparatus to be loaded with slurry.

2. The apparatus of claim 1, wherein the power unit is a combustion engine which is coupled to a hydraulic converter, the combustion engine supplying power to the hydraulic converter.

3. The apparatus of claim 2, wherein the hydraulic converter drives the suction pump and the delivery pump.

4. The apparatus of claim 3, wherein the suction pump delivers lime slurry within the tank body to the delivery outlet.

5. The apparatus of claim 1, wherein the mixer is an auger which is located within the tank body for mixing the solid and water within the tank body to form the lime slurry.

6. A single-entity reactor apparatus for lime slurry production and delivery to remote jobsites comprising:

a unitary frame substantially parallel to the ground and having a horizontal axis;

a tank body attached to the frame, the tank body having a horizontal axis parallel to the horizontal axis of the frame, a generally cylindrical exterior and an interior surface, the interior surface forming a mixing chamber;

a power unit coupled to the frame and connected to a mixer located within the mixing chamber, the power unit also being connected to a suction pump and a delivery pump, both of which are located externally of the tank body, for powering the mixer, suction pump, and delivery pump;

the power unit having a combustion engine and a hydraulic converter, the combustion engine powering the hydraulic converter and the hydraulic converter powering the mixer, suction pump, and delivery pump;

the suction pump coupled to a delivery outlet, the delivery outlet rotatable about a vertical axis from one side of the tank body to the other and extendable upwards in order to deliver lime slurry to a vehicle parked next to the apparatus;

a vertical placement means for placing the frame, tank body, and power unit in a working position once at a jobsite and a raised position when pulling the apparatus on a highway, the working position being such that the frame is against the ground and supporting the tank body and the raised position being such that the frame and tank body clear the ground surface sufficiently to travel on a highway; and a pair of spaced apart inlets located on the generally cylindrical exterior of the tank body for introducing solid lime below the surface of water or slurry within the mixing chamber; and wherein the inlets are located at spaced apart vertical locations on the generally cylindrical exterior of the tank body, the inlets being located above an imaginary midline drawn to intersect the cylindrical exterior and with respect to an imaginary vertical axis drawn to divide the sidewall into quadrants.

7. The apparatus of claim 6, wherein the mixer is an auger which mixes the water and solid lime added to the tank body to form the slurry.

8. The apparatus of claim 6, wherein a recirculator inlet is provided on the tank body to allow the delivery outlet to recirculate slurry into the tank body.

9. The apparatus of claim 6, wherein the delivery outlet can be retracted for transport of the apparatus on a highway.

10. A method of forming and delivering a lime slurry to a remote jobsite using a single-entity reactor apparatus, the method comprising:

providing a unitary frame substantially parallel to the ground and having a horizontal axis;

providing a tank body attached to the frame, the tank body having a horizontal axis parallel to the horizontal axis of the frame, a generally cylindrical exterior and an interior surface, the interior surface forming a mixing chamber;

a power unit coupled to the frame and connected to a mixer located within the mixing chamber, the power unit also being connected to a suction pump and a delivery pump, both of which are located externally of the tank body, for powering the mixer, suction pump, and delivery pump;

providing a vertical placement means for placing the frame, tank body, and power unit in a working position once at a jobsite and a raised position when pulling the apparatus on a highway, the working position being such that the frame is against the ground and supporting the tank body and the raised position being such that the frame and tank body clear the ground surface sufficiently to travel on a highway;

pulling the apparatus with a vehicle to a remote jobsite, the apparatus being in the raised position;

lowering the apparatus to the working position at the jobsite;

providing at least a pair of spaced apart inlets located on the generally cylindrical exterior of the tank body for introducing solid lime below the surface of the water or slurry within the mixing chamber;

first introducing water to the tank body, then introducing a solid powder lime to the tank body through the inlets;

mixing the solid and water using the mixer provided within the tank body;

and delivering the resultant lime slurry to vehicles parked on either side of the tank body through a delivery outlet provided by the apparatus, the delivery outlet being rotatable from one side of the tank body to the other and extendable upwards in order to deliver lime slurry to a vehicle parked next to the apparatus, the slurry being pumped by the suction pump.

11. The method of claim 10, wherein wheels are attached to the unitary frame for transporting the apparatus to a jobsite.

12. The method of claim 10, wherein a hitch is provided to the unitary frame for attaching the apparatus to the vehicle which is used for transporting the apparatus to a jobsite.

13. The method of claim 12, wherein wheels are attached to a rear platform of the frame to facilitate transport of the apparatus to a jobsite.

14. The method of claim 13, wherein the wheels are retractable using a hydraulic power unit, thus serving as the vertical placement means.

* * * * *